United States Patent [19]

Saeki et al.

[11] Patent Number: 4,803,192

[45] Date of Patent: Feb. 7, 1989

[54] RECORDING MATERIAL

[75] Inventors: Keiso Saeki; Masanobu Takashima; Ken Iwakura, all of Shizuoka, Japan

[73] Assignee: Fuji Photo Film Co., Ltd., Kanagawa, Japan

[21] Appl. No.: 71,679

[22] Filed: Jul. 9, 1987

[30] Foreign Application Priority Data

Jul. 9, 1986 [JP] Japan ..... 61-161494
Jul. 28, 1986 [JP] Japan ..... 61-177380

[51] Int. Cl.[4] ..... B41M 5/16; B41M 5/18; B41M 5/22

[52] U.S. Cl. ..... 503/212; 427/151; 428/913; 428/914; 503/215; 503/217; 503/220; 503/223

[58] Field of Search ..... 427/150-152; 503/220, 223, 225, 217, 212, 215, 216; 549/307; 428/195, 913, 914

[56] References Cited

U.S. PATENT DOCUMENTS

| | | | |
|---|---|---|---|
| 3,491,116 | 1/1970 | Lin | 503/223 |
| 4,062,866 | 12/1977 | Garner et al. | 503/223 |
| 4,351,768 | 9/1982 | Crounse et al. | 503/220 |
| 4,660,060 | 4/1987 | Hung et al. | 503/223 |

FOREIGN PATENT DOCUMENTS

| | | | |
|---|---|---|---|
| 1460151 | 12/1976 | United Kingdom | 503/220 |
| 1464251 | 2/1977 | United Kingdom | 503/220 |
| 1499077 | 1/1978 | United Kingdom | 503/223 |

*Primary Examiner*—Bruce H. Hess
*Attorney, Agent, or Firm*—Sughrue, Mion, Zinn, Macpeak & Seas

[57] ABSTRACT

A recording material containing the combination of a colorless dye comprising a p-substituted amino-phenylindolylphthalide moiety and an electron-accepting compound comprising an organic acid having at least one phenolic hydroxyl group. The dye image obtained by the recording material is stable.

18 Claims, No Drawings

RECORDING MATERIAL

FIELD OF THE INVENTION

This invention relates to a recording material utilizing a color formation reaction between an electron donating colorless dye and an electron accepting compound, and more particularly to a recording material providing a color image having improved stability.

BACKGROUND OF THE INVENTION

Known recording materials using a combination of an electron donating colorless dye (hereinafter referred to as color former) and an electron accepting compound (hereinafter referred to as color developer) include pressure-sensitive paper, heat-sensitive paper, light- and pressure-sensitive paper, electric heat-sensitive paper, and the like. The details of these recording materials are described, e.g., in British Patent No. 2,140,449, U.S. Pat. Nos. 4,480,052, 4,436,920, 3,491,112, 3,829,322 and 4,062,866, Japanese patent publication No. 23992/85, (corresponding to U.S. Pat. No. 4,181,328 and British patent No. 1,552,517) and Japanese Patent Application (OPI) Nos. 179836/82, 123556/85, and 123557/85 (the term "OPI" as used herein means an "unexamined published Japanese patent application").

These recording materials are required (1) to provide an image having sufficient color density with sufficient color formation sensitivity, (2) not to fog, (3) to provide an image having sufficient fastness, (4) to form a hue suited for copying machines, (5) to have a high S/N ratio, (6) to provide an image sufficiently resistant to chemicals, (7) to be easy to dissolve in an organic solvent, and the like. Further, compounds used in the preparation of the recording materials must be soluble in organic solvents. However, none of the conventional recording materials has completely fulfilled these requirements.

With the recent diversification of demands for recording systems, extensive studies have been conducted to improve the aforesaid performance properties. Of various recording materials, blue-forming recording materials are particularly sought that satisfy the above requirement (3).

Known compounds which form a blue to bluish purple color include diphenylmethane compounds, triphenylmethane compounds, phthalide compounds, and Leucomethylene Blue type compounds. However, each of the known compounds has its respective disadvantages. For example, 3,3-bis(p-dimethylaminophenyl)-6-dimethylaminophthalide (Crystal Violet Lactone), though developing a deep blue color at high rate, provides an image extremely poor in light-fastness. 3,7-Bis(-dimethylamino)-10-benzoylphenothiazine (Benzoyl Leucomethylene Blue) provides a color image exhibiting excellent light-fastness, but has a very low rate of color formation and very inferior color developability if combined with an organic color developer. Further, 3-(4-diethylamino-2-ethoxyphenyl)-3-(1-ethyl-2-methylindol-3-yl)-4 or 7-azaphthalide, known as a phenylindolylazaphthalide compound, has the disadvantages of poor solubility in solvents used for encapsulization and strong self-color-developing properties.

The inventors have investigated each of these color formers and color developers, paying attention to their solubility in oil or water, partition coefficients, pKas, the polarity of substituents, position of substitution, changes in crystallizability and solubility when used in combination, and the like.

SUMMARY OF THE INVENTION

One object of this invention is to provide a recording material which provides a color image having satisfactory stability.

It has now been found that the above object can be accomplished by a recording material comprising the combination of at least one p-substituted aminophenylindolylphthalide moiety (derivative) as a color former and at least one organic acid having at least one phenolic hydroxyl group as a color developer.

DETAILED DESCRIPTION OF THE INVENTION

The p-substituted aminophenylindolylphthalide derivative which can be used as a color former in the present invention preferably includes those represented by formula (I)

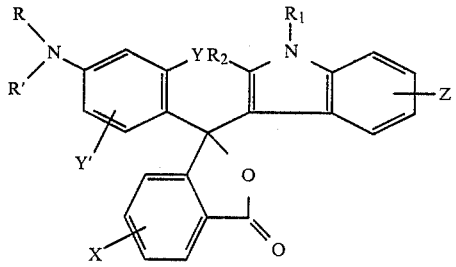

(I)

wherein R and R', which may be the same or different, each represents a substituted or unsubstituted alkyl group; $R_1$ and $R_2$, which may be the same or different, each represents a substituted or unsubstituted alkyl group or a substituted or unsubstituted aryl group; X represents a hydrogen atom, a substituted or unsubstituted alkyl group, a substituted or unsubstituted alkoxy group, a substituted or unsubstituted aryloxy group or a halogen atom; and Y, Y', and Z, which may be the same or different, each represents a hydrogen atom, a substituted or unsubstituted alkyl group, a halogen atom, a substituted amino group or a substituted or unsubstituted alkoxy group.

In formula (I), the aryl group includes a phenyl group, a naphthyl group, and a heterocyclic aromatic group. Substituents for the aryl group include an alkyl group, an alkoxy group, an aryloxy group, a halogen atom, a nitro group, a cyano group, a substituted carbamoyl group, a substituted sulfamoyl group, a substituted amino group, a substituted oxycarbonyl group, and a substituted or oxysulfonyl group. The alkyl group may be saturated or unsaturated and cyclic or acylic. Substituents for the alkyl group include an aryl group, an alkoxy group, an aryloxy group, a halogen atom, and a cyano group.

R and R' each preferably represents an alkyl group having from 1 to 10 carbon atoms, an alkoxyalkyl group having from 2 to 10 carbon atoms, a halogen-substituted alkyl group having from 1 to 10 carbon atoms or an aryloxyalkyl group having from 7 to 12 carbon atoms. $R_1$ preferably represents an alkyl group having from 1 to 12 carbon atoms which may be substituted with an aryl group, an alkoxy group, an aryloxy group or a halogen atom, or a phenyl or naphthyl group having from 6 to 10 carbon atoms which may be substituted with an alkyl group, an alkoxy group or a halogen atom. $R_2$ preferably represents an alkyl group having from 1 to 8 carbon atoms, or a phenyl or naphthyl group having from 6 to 10 carbon atoms. X preferably represents a hydrogen atom, an alkoxy group having from 1 to 6 carbon atoms, an aryloxy group having from 6 to 10 carbon atoms, a chlorine atom or a fluorine atom. Y and Y' each preferably represents a hydrogen atom, an alkyl group having from 1 to 12 carbon atoms, an acyloxy group, a substituted amino group or an alkoxy group, and more preferred Y is an alkoxy group. Z preferably represents a hydrogen atom, an alkyl group having from 1 to 6 carbon atoms or an alkoxy group.

The compounds of formula (I) wherein $R_2$ is an alkyl group with the total number of carbon atoms in R, R', Y, $R_1$, and $R_2$ being 11 or more or the total number of carbon atoms in $R_1$ and Y being 4 or more, or wherein $R_2$ is an aryl group with the total number of carbon atoms in R, R', Y, $R_1$, and $R_2$ being 14 or more, or wherein $R_2$ is an alkyl group and Y is an alkoxy group with the carbon atoms of $R_1$ or Y being 4 or more, preferably 6 to 12, are preferred because of their enhanced solubility in organic solvents.

Specific examples of the p-substituted aminophenylindolylphthalide derivatives represented by formula (I) include:

3-(4-diethylamino-2-ethoxyphenyl)-3-(1-ethyl-2-methylindol-3-yl)phthalide,
3-(4-diethylamino-2-ethoxyphenyl)-3-(1-isoamyl-2-methylindol-2-yl)phthalide,
3-(4-diethylamino-2-ethoxyphenyl)-3-(1-β-ethoxyethyl-2-methylindol-3-yl)phthalide,
3-(4-diethylamino-2-ethoxyphenyl)-3-(1-β-phenoxyethyl-2-methylindol-3-yl)phthalide,
3-(4-dibutylamino-2-ethoxyphenyl)-3-(1-ethyl-2-methylindol-3-yl)phthalide,
3-(4-diethylamino-2-ethoxyphenyl)-3-(1-ethyl-2-phenylindol-3-yl)phthalide,
3-(4-N-cyclohexyl-N-ethylamino-2-ethoxyphenyl)-3-(1-ethyl-2-methylindol-3-yl)phthalide,
3-(4-N-ethyl-N-isoamylamino-2-isoamyloxyphenyl)-3-(1-ethyl-2-methylindol-3-yl)phthalide,
3-(4-diethylamino-2-methylphenyl)-3-(1-ethyl-2-methylindol-3-yl)phthalide,
3-(4-N-cyclohexyl-N-ethylamino-2-ethoxyphenyl)-3-(1-ethyl-2-methylindol-3-yl)phthalide,
3-(4-N-butyl-N-ethylamino-2-methylphenyl)-3-(1-ethyl-2-methylindol-3-yl)phthalide,
3-(4-diethylaminophenyl)-3-(1-ethyl-2-methylindol-3-yl)phthalide,
3-(4-diethylamino-2-ethoxyphenyl)-3-(1-hexyl-2-methylindol-3-yl)phthalide,
3-(4-diethylamino-2-ethoxyphenyl)-3-[1-(2-ethylhexyl)-2-methylindol-3-yl]phthalide,
3-(4-diethylamino-2-ethoxyphenyl)-3-(1-ethyl-2-methylindol-3-yl)-5 or 6-methoxyphthalide,
3-(4-diethylamino-2-ethoxyphenyl)-3-(1-ethyl-2-methylindol-3-yl)-5 or 6-chlorophthalide,
3-(4-diethylamino-2-ethoxyphenyl)-3-(1-ethyl-2-methylindol-3-yl)-5 or 6-chlorophthalide,
3-(2,4-diethylaminophenyl)-3-(1-ethyl-2-methylindol-3-yl)phthalide,
3-[4-diethylamino-2-(2-ethylhexyloxy)phenyl]-3-(1-ethyl-2-methylindol-3-yl)phthalide,
3-(4-diethylamino-2-n-decyloxyphenyl)-3-(1-ethyl-2-methylindol-3-yl)phthalide,
3-(4-diethylamino-2-isopentyloxyphenyl)-3-(1-ethyl-2-methylindol-3-yl)phthalide,
3-(4-diethylamino-2-ethoxyphenyl)-3-(1-dodecyl-2-methylindol-3-yl)phthalide,
3-(4-diethylamino-2-ethoxyphenyl)-(1-benzyl-2-methylindol-3-yl)phthalide, and
3-(4-diethylamino-2-ethoxyphenyl)-3-(1-n-octyl-2-methylindol-3-yl)phthalide.

Of these p-substituted aminophenylindolylphthalide derivatives according to the present invention, preferred are 4-substituted amino-2-alkoxyphenylindolylphthalides, from the standpoint of the developed hues.

The color former according to the present invention can be prepared by known processes, as described, for example, in U.S. Pat. No. 4,062,866, Japanese Patent Publication No. 21329/73, etc. For example, the compounds can be prepared by reacting a corresponding benzoylbenzoic acid with a corresponding indole or a corresponding carboxybenzoylindole with a corresponding aniline derivative in the presence of a condensing agent, e.g., acetic anhydride, phosphorous exychloride, etc., with or without a volatile organic inert solvent, e.g., chloroform, toluene, chlorobenzene, etc., at a temperature of from 50° to 130° C. for a period of from 1 to 10 hours, pouring the reaction mixture into ice-water or cold dilute hydrochloric acid to hydrolyze the condensing agent, adding the aforesaid volatile organic inert solvent thereto, rendering the mixture alkaline with a sodium hydroxide aqueous solution, transferring the formed dye to the solvent, and removing the solvent by distillation under reduced pressure. Typical synthesis examples are described below.

SYNTHESIS EXAMPLE 1

Synthesis of 3-(4-Diethylamino-2-Ethoxyphenyl)-3-(1-Ethyl-2-Methylindol-3-yl)Phthalide In a flask were charged 0.05 mol of m-diethyl-aminophenetidine and 0.05 mol of 3-(o-carboxybenzoyl)-1-ethyl-2-methylindole obtained by reacting 1-ethyl-2-methylindole and phthalic anhydride, and 0.3 mol of acetic anhydride was added thereto, followed by heating at 60° to 80° C. The reaction proceeded rapidly, and the reaction system assumed a bluish purple color. The reaction mixture was poured into water, and the precipitated crystals were collected by filtration and recrystallized from toluene to obtain the above-named compound having a melting point of 193° C.

SYNTHESIS EXAMPLE 2

Synthesis of 3-(4-Diethylamino-2-Benzyloxyphenyl)-3-(1-Ethyl-2-Methylindol-3-yl)Phthalide The above-named compound having a melting point of 138° C. was obtained in the same manner as in Synthesis Example 1, except for replacing m-diethylphenetidine with m-diethylaminobenzyloxybenzene.

SYNTHESIS EXAMPLE 3

Synthesis of 3-(4-Diethylamino-2-Isopropoxyphenyl)-3-(1-Ethyl-2-Methylindol-3-yl)Phthalide The above-named compound having a melting point of 193° C. was obtained in the same manner as in Synthesis Example 1, except for replacing m-diethylphenetidine with m-diethylamino-isopropoxybenzene.

The organic acid having at least one phenolic hydroxyl group which can be used as a color developer in the recording materials of the present invention preferably includes salicylic acid derivatives, phenol derivatives and phenolic resins.

Preferred among these color developers are salicylic acid derivatives, in view of the developed hue having an absorption peak in the wavelength region of from 570 to 620 nm and the light-fastness of the developed color image.

Specific examples of the phenol derivatives include 4-t-butylphenol, 4-phenylphenol, 4-hydroxydiphenoxide, α-naphthol, β-naphthol, hexyl 4-hydroxybenzoate, 2, 2'-dihydroxybiphenyl, 2,2'-bis(4-hydroxyphenyl)propane (bisphenol A), 4,4'-isopropylidenebis(2-methylphenol), 1,1-bis(3-chloro-4-hydroxyphenyl)cyclohexane, 1,1-bis(3-chloro-4-hydroxyphenyl)-2-ethylbutane, 4,4'-secisooctylidenediphenol, 4-t-octylphenol, 4,4'-sec-butylidenediphenol, 4-p-methylphenylphenol, 4,4'-isopentylidenediphenol, 4,4'-methylcyclohexylidenediphenol, 4,4'-dihydroxydiphenyl sulfide, 1,4-bis(4'-hydroxycumyl)benzene, 1,3-bis-(4'-hydroxycumyul)-benzene, 4,4'-thiobis(6-t-butyl-3-methylphenol), 4,4'-dihydroxydiphenylsulfone, hydroquinone monobenzyl ether, 4-hydroxybenzophenone, 2,4-dihydroxybenzophenone, polyvinylbenzyloxycarbonylphenol, 2,4,4'-trihydroxybenzophenone, 2,4',4,4'-tetrahydroxybenzophenone, dimethyl 4-hydroxyphthalate, methyl 4-hydroxybenzoate, 2,4,4'-trihydroxydiphenylsulfone, 1,5-bis-p-hydroxyphenylpentane, 1,6-bis-p-hydroxyphenoxyhexane, tolyl 4-hydroxybenzoate, α-phenylbenzyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydrxybenzoate, benzyl 4-hydroxybenzoate, m-chlorobenzyl 4-hydroxybenzoate, β-phenethyl 4-hydroxybenzoate, 4-hydroxy-2',4 '-dimethyl diphenylsulfone, β-phenethyl orsellinate, cinnamyl orsellinate, o-chlorophenoxyethyl orsellinate, o-ethylphenoxyethyl orsellinate, o-phenylphenoxyethyl orsellinate, m-phenylphenoxyethyl orsellinate, β-3'-t-butyl-4'-hydroxyphenoxyethyl 2,4-dihydroxybenzoate, 1-t-butyl-4-p-hydroxyphenylsulfonyloxybenzene, 4-N-benzylsulfamoylphenol, p-methylbenzyl 2,4-dihydroxybenzoate, β-phenoxyethyl 2,4-dihydroxybenzoate, benzyl 2,4-dihydroxy-6-methylbenzoate, methyl bis-4-hydroxyphenylacetate, ditolylthiourea, and 4,4'-diacetyldiphenylthiourea.

Specific examples of the phenolic resin include a p-substituted phenol-formaldehyde resin, and a p-substituted phenolacetylene resin.

The salicylic acid derivatives preferably include mono- or di-substituted salicylic acid derivatives having 13 or more carbon atoms and metal salts thereof, more preferably the di-substituted salicylic acid derivatives or metal salts thereof. Substituents for the salicylic acid derivatives include an alkyl group having from 1 to 12 carbon atoms, an aralkyl group having from 7 to 20 carbon atoms, a substituted or unsubstituted alkoxy group having from 1 to 20 carbon atoms, and a halogen atom. Specific examples of the salicylic acid derivatives are 3-phenylsalicylic acid, 3-cyclohexylsalicylic acid, 3,5-di-t-butylsalicylic acid, 3,5-di-dodecylsalicylic acid, 3-methyl-5-benzylsalicylic acid, 3-phenyl-5-(α,α-dimethylbenzyl)salicylic acid, 3,5-di-(α-methylbenzyl)salicylic acid, 3,5-di-cyclohexylsalicylic acid, 4-dodecyloxysalicylic acid, 4-octadecyloxysalicylic acid, 4-benzyloxysalicylic acid, 4-β-phenethyloxysalicylic acid, 4-β-phenoxyethoxysalicylic acid, 4-(4phenoxybutoxy)-salicylic acid, 5-(p'-α'-methylbenzyl-p'-α-methylbenzyl)salicylic acid, 5-α-methyl-4'-phenylbenzylsalicylic acid, 4-β-p-tolyloxyethoxysalicylic acid, 4-β-p-methoxyphenoxyethoxysalicylic acid, and 4-β-p-butylphenoxyethoxysalicylic acid, a carboxy-modified product of terpene phenolic resins comprising a gum turpentine and a phenol, a carboxy-modified product of terpene phenolic resin comprising a dipentene and a phenol and metal salts thereof (e.g., zinc salts, aluminum salts, calcium salts, etc.).

These color developers can be used either individually or in combinations thereof.

The recording material according to the present invention is characterized by a combination of the above-described specific color former and color developer. Colors developed by the recording material of the invention are markedly stable as compared with any of the colors developed by conventional recording materials and do not undergo substantial discoloration or decoloration even when exposed to light, heat or moisture for a long period of time.

Preferred among the above-described combinations of a color former and a color developer is the combination of 4-substituted amino-2-alkoxyphenylindolylphthalides and a metal salt of salicylic acid derivatives, from the standpoint of the light-fastness of the developed color image. As a metal salt of salicylic acid derivatives, zinc salts are particularly preferred, in view of the light-fastness of the developed color image.

If desired, the p-substituted aminophenylindolylphthalide of the present invention may be used in combination with various known colorless dyes, such as triphenylmethanephthalide compounds, fluoran compounds, phenothidazine compounds, indolylazaphthalide compounds, Leuco Auramine compounds, Rhodamine Lactam compounds, triphenylmethane compounds, triazene compounds, spiropyran compounds, etc. In this case, it is desirable to use the color former(s) according to the present invention in a proportion of at least 60% by weight based on the total amount of color formers.

The combination of the color former and color developer in accordance with the present invention is applicable to various types of recording materials, such as pressure-sensitive recording materials, heat-sensitive recording materials, light- and heat-sensitive recording materials, and electric heat-sensitive recording materials. For the production of these recording materials, the abovementioned color former and color developer are used in the form of a fine dispersion or fine droplets.

The pressure-sensitive recording materials according to the present invention include an embodiment composes of an upper sheet comprising a support having coated thereon a microcapsule layer containing microcapsules of a color former dissolved in an appropriate solvent and a lower sheet comprising a support having coated thereon a color developer layer containing a color developer, and if desired, an intermediate sheet comprising a support having coated on one side thereof a microcapsule color former layer and on the other side thereof a color developer layer; an embodiment comprising a support having coated thereon a layer containing the above-described color former microcapsules and color developer; and on embodiment comprising a support containing either one of the above-described color former microcapsules or color developer having coated thereon a layer containing the other.

These pressure-sensitive recording materials are described, e.g., in U.S. Pat. Nos. 2,505,470, 2,505,489, 2,550,471, 2,730,457, and 3,418,250.

The walls of microcapsules containing a color former preferably are formed of synthetic resins prepared by interfacial polymerization, internal polymerization or external polymerization. Specific examples of the synthetic resins include polyurethane, polyurea, polyurethaneurea, and melamine/formaldehyde resins.

If the color former-containing microcapsules are prepared by the commonly known process utilizing coacervation of a hydrophilic colloid sol, such as gelatin, the resulting microcapsules often are found to cause fog upon contact with water or transfer fog when preserved under a high humidity condition.

In general, a color former or a mixture thereof is dissolved in a solvent, and the solution is encapsulized by any of the above-described processes. The solution used includes synthetic oils, e.g., alkylated naphthalenes, alkylated diphenyls, alkylated diphenylmethanes, alkylated terphenyls, chlorinated paraffins, etc.; vegetable oils, e.g., cotton seed oil, caster oil, etc.; animal oils; mineral oils; and mixtures thereof. The microcapsule-containing dispersion is coated on a support, e.g., paper, fine paper, a plastic sheet, resin-coated paper, etc., to form a color forming sheet. Neutral paper is particularly preferred as a support.

Since the color formers represented by formula (I) or combinations containing the same exhibit high solubility in synthetic oils, such as alkylated naphthalenes, alkylated diphenyls, alkylated diphenylalkanes, etc., they offer the advantage that paraffin oils having lower dissolving capacities can also be use for dissolution.

If desired, the microcapsules may further contain various additives in addition to the color former, such as ultraviolet absorbents, antioxidants, and the like. In particular, it is preferable to add a benzotriazole type ultraviolet absorbent, a hindered amine type antioxidant, a hindered phenol type antioxidant, an aniline type antioxidant, a quinoline type antioxidant, etc. for the purpose of improving stability of the color former in the capsules and preventing coloration of capsules.

The color developer of the present invention, either alone, in a combination of two or more thereof, or in combination with other known color developers is dispersed in a binder, such as a styrene-butadiene latex, polyvinyl alcohol, etc., together with a pigment. The color developer dispersion is coated on a support, such as paper, a plastic sheet, resin-coated paper, neutral paper, etc., to obtain a color developer sheet.

The amounts of the color former and color developer to be used can be selected appropriately depending on the desired film thickness, the form of the pressure-sensitive recording material, the process for encapsulization, and other conditions. It is easy for one skilled in the art to make such a selection. In general, it is especially preferred that the color former and the color developer in the recording materials according to the present invention are used at a weight ratio of from about 1:10 to 2:3.

In the case of pressure-sensitive recording materials, the color former and the color developer can be preferably used at a weight ratio of from about 1:20 to 1:1, and more preferably from about 1:10 to 2:3 in view of the light-fastness of the developed color image.

Heat-sensitive recording materials to which the present invention can be applied include various embodiments as described in West German patent publication (OLS) Nos. 2,228,581 and 2,110,854 and Japanese patent publication No. 20142/77. A coating composition for a heat-sensitive recording layer is prepared by finely dispersing each of the color forming components (i.e., a color former and a color developer) in a binder to a particle size of about 10 μm or smaller, and preferably about 3 μm or smaller, by means of a ball mill, sand mill, a horizontal sand mill, an attritor, a colloid mill, etc.

In the case of heat-sensitive recording materials, the color former and the color developer can be preferably used at a weight ratio of from about 1:10 to 1:1, and more preferably from about 1:5 to 2:3 in view of light-fastness of the developed color image.

In the preparation of the dispersion, it is preferable to use, in combination with the color former or color developer, a heat-fusible compound having a melting point of from about 75° to 130° C., such as a nitrogen-containing organic compound, e.g., a fatty acid amide, acetoacetic anilide, diphenylamine, benzamide, carbazole, etc.; 2,3-di-m-tolylbutane, o-fluorobenzoyldurene, chlorobenzoylmesitylene, 4,4'-dimethylbiphenyl; a carboxylic acid ester, e.g., dimethyl isophthalate, diphenyl phthalate, dimethyl terephthalate, methacryloxybiphenyl, etc.; a polyether compound, e.g., di-m-tolyloxyethane, β-phenoxyethoxyanisole, 1-phenoxy2-p-ethylphenoxyethane, bis-β-(p-methoxyphenoxy)ethoxymethane, 1,2'-methylphenoxy-2''-ethylphenoxyethane, 1-tolyloxy-2-p-methylphenoxyethane, 1,2-diphenoxyethane, 1,4-diphenoxybutane, bis-β-(pethoxyphenoxy)ethyl ether, 1-phenoxy-2-p-chlorophenoxyethane, 1,2'-methylphenoxy-2,4''-ethyloxyphenoxyethane, 1,4'-methyl-phenoxy-2,4''-fluorophenoxyethane, etc. From the standpoint of prevention of fog, it is particularly preferable to use such a compound together with the color former. The amount of these compounds to be added ranges from about 20 to 300%, and preferably from about 40 to 150%, by weight based on the color developer.

The dispersion of the color forming component may further contain any conventional additives for meeting various performance requirements. Such additives include pigments, waxes (e.g., paraffin wax, carboxy-modified paraffin wax, carnauba wax, microcrystalline wax, polyethylene wax, fatty acid esters, etc.), metal soaps (e.g., polyvalent metal salts of higher fatty acids, e.g., zinc stearate, aluminum stearate, calcium stearate, zinc oleate, etc.), antistatics, ultraviolet absorbents, defoaming agents, conductive agents, fluorescent dyes, surface active agents, and the like. These additives are preferably added in an amount of about 5 to 300% by weight, and preferably from about 15 to 200% by weight, based on the total weight of color former and color developer. The pigment to be used is selected from those having a particle size of from about 0.1 to 15 μm and includes kaolin, calcined kaolin, talc, agalmatolite, diatomaceous earth, calcium carbonate, aluminum hydroxide, magnesium hydroxide, calcined gypsum, silica, magnesium carbonate, titanium oxide, alumina, barium carbonate, barium sulfate, mica, microbaloon, a urea-formalin filler, polyethylene particles, a cellulose filler, etc. In particular, the inorganic pigments or oil-absorbing substances, e.g., a polyurea filler, are used for preventing a recording head from contamination during recording, and fatty acids or metallic soaps are added for improving releasability from the recording head.

The binder to be used is generally water-soluble and includes polyvinyl alcohol, hydroxyethyl cellulose, hydroxypropyl cellulose, epichlorohydrin-modified polyamide, an ethylene-maleic anhydride copolymer, a styrene-maleic anhydride copolymer, an isobutylene-maleic anhydride copolymer, polyacrylic acid, polyacrylamide, methylol-modified polyacrylamide, a starch derivative, casein, gelatin, and the like. These binders are used in concentrations of from about 0.5 to about 10% by weight of the total dispersion. For the purpose of imparting water-resistance to the binder, a water-proofing agent (e.g., a gelling agent and a cross-linking ageht) or an emulsion of a hydrophobic polymer (e.g., a styrene-butadiene rubber latex, an arylic resin emulsion, etc.) can be added to the binder.

The thus prepared coating composition is coated on a support, such as base paper, fine paper, synthetic paper, a plastic sheet, polyethylene-laminated fine paper, neutral paper, etc., to a coverage of from about 2 to about 10 g per $m^2$.

If desired, durability of the heat-sensitive recording layer can be enhanced by providing a protective layer comprising a water-soluble or water-dispersible polymeric compound, e.g., polyvinyl alcohol, hydroxyethyl starch, epoxy-modified polyacrylamide, etc. to a thickness of from about 0.2 to about 2 μm.

Prior to heat-recording, the heat-sensitive recording material may be subjected to preheating, moisture conditioning, or stretching.

Electric heat-sensitive recording materials to which the present invention can be applied are produced by, for example, the process described in Japanese patent application (OPI) Nos. 11344/74 and 48930/75. In general, the electric heat-sensitive recording materials are produced by coating a dispersion of a conductive substance, and the color forming components according to the present invention in a binder on a support, e.g., paper; or coating a conductive substance on a support to form a conductive layer and further coating thereon a dispersion of the color forming components in a binder. If desired, heat sensitivity can be improved by adding the aforesaid heat-fusible compound to the dispersion.

Light- and pressure-sensitive recording materials to which the present invention is applied can be prepared by, for example, the process disclosed in Japanese patent Application (OPI) No. 179836/82. In general, the color former according to the present invention is encapsulized together with a photopolymerization initiator (e.g., silver iodobromide, silver bromide, silver behenate, Michler's ketone, a benzoin derivative, a benzophenone derivative, etc.), a polyfunctional monomer (e.g., an allyl compound, a (meth)acrylate, a (meth)acrylamide, etc.) as a cross-linking agent and, if desired, a solvent. The wall-forming material is preferably selected from synthetic resins, such as polyether urethane, polyurea, etc., for the same reasons as recited with respect to pressure-sensitive recording materials. Recording on the light- and pressure-sensitive recording material is carried out by imagewise exposing to light and contacting the color former in the unexposed areas with the color developer to develop a color image.

The present invention will now be illustrated in greater detail by way of the following examples and comparative examples, but the present invention is not to be construed as being limited thereto. In these examples, all parts ratios and percents are by weight unless otherwise indicated.

EXAMPLES 1 TO 4 AND COMPARATIVE EXAMPLES 1 TO 2

Preparation of Color Former Sheet

One gram of the color former shown in Table 1 was dissolved in 30 g of an alkylated naphthalene (diisopropylnaphthalene), and the solution was added to a solution of 6 g of gelatin and 4 g of gum arabic in 50 g of water while vigorously stirring to prepare an emulsion of oil droplets having a diameter of from 1 to 10 μm. Acetic acid was added to the emulsion in small portions until a pH of about 4 was reached, whereupon coacervation was induced to form capsule walls comprising gelatin and gum arabic around the oil droplets. After 37% formalin was added thereto, the dispersion was adjusted to a pH of 9 to harden the walls.

The resulting microcapsule dispersion was coated on paper and dried (coverage of 5 g/$m^2$) to obtain a color former sheet.

Preparation of Color Developer Sheet

In 200 g of a 5% aqueous solution of polyvinyl alcohol was dispersed 20 g of the color developer shown in Table 1, and 20 g of kaolin (Georgia Kaolin) was further dispersed therein. The resulting coating composition was coated on paper and dried (coverage of 6 g/$m^2$) to obtain a color developer sheet.

When the color former sheet and the color developer sheet were brought into contact with their coating layers facing each other and pressure (writing pressure) or impact was applied thereto, a practically usable blue image was obtained instantaneously.

In order to evaluate light-fastness of the thus-obtained blue image, the image was exposed to light of 32,000 lux for 10 hours, and the percentage of retention of color was calculated by the equation:

$$\text{Retention of Color (\%)} = \frac{\text{Color Density after Light-Exposure}}{\text{Color Density before Light-Exposure}} \times 100$$

The results of retention of color were rated as follows and shown in Table 1.

| | |
|---|---|
| 75% or more: | Excellent |
| from 50 to 75%: | Good |
| from 25 to 50%: | Poor |
| 25% or less: | Very poor |

TABLE 1

| Run No. | Color Former | Color Developer | Light-Fastness |
|---|---|---|---|
| Example 1 | 3-(4-diethylamino-2-ethoxyphenyl)-3-(1-ethyl-2-methylindol-3-yl)phthalide | zinc 3,5-bis(α-methylbenzyl) salicylate | Excellent |
| Example 2 | 3-(4-diethylamino-2-ethoxyphenyl)-3-[1-(2-ethylhexyl)-2-methylindol-3-yl]-phthalide | zinc 3,5-bis(α-methylbenzyl) salicylate | Excellent |

TABLE 1-continued

| Run No. | Color Former | Color Developer | Light-Fastness |
|---|---|---|---|
| Example 3 | 3-(4-dibutylamino-2-ethoxyphenyl)-3-(1-ethyl-2-methylindol-3-yl)phthalide | zinc 3,5-bis(α-methylbenzyl) salicylate | Excellent |
| Example 4 | 3-(4-diethylamino-2-ethoxyphenyl)-3-(1-ethyl-2-methylindol-3-yl)phthalide | zinc 5-α-(α-methylbenzyl)phenethyl salicylate | Excellent |
| Comparative Example 1 | Crystal Violet Lactone | zinc 3,5-bis(α-methylbenzyl) salicylate | Poor |
| Comparative Example 2 | 3-(4-diethylamino-2-ethoxyphenyl)-3-(1-ethyl-2-methylindol-3-yl)phthalide | silton clay | Poor |

It can be seen from the results of the Table, that the recording materials using the color former-color developer combination according to the present invention are superior to the comparative samples in light-fastness of the color image produced.

EXAMPLE 5

Preparation of Color Former Sheet

Five parts of a partial sodium salt of polyvinylbenzencsulfonic acid ("VERSA TL500" produced by National Starch Co., Ltd.; average molecular weight: 500,000) were stirred in 95 parts of hot water at about 80° C. over about 30 minutes to form a solution, followed by cooling. The resulting aqueous solution had a pH of from 2 to 3. The aqueous solution was then adjusted to a pH of 4.0 with a 20% aqueous solution of sodium hydroxide.

In 100 parts of the resulting 5% aqueous solution of the partial sodium salt of polyvinylbenzenesulfonic acid was dispersed 100 parts of diisopropylnaphthalene having dissolved therein 3.5% of 3-(4-diethylamino-2-ethoxyphenyl)-3-(1-octyl-2-methylindol-3-yl)phthalide to prepare an emulsion having droplets of 4.5 μm in mean diameter.

Separately, 6 parts of melamine, 11 parts of a 37% formaldehyde aqueous solution, and 30 parts of water were heated at 60° C. while stirring for 30 minutes to obtain a clear mixed aqueous solution of melamine, formaldehyde, and a melamine-formaldehyde initial condensation product (hereinafter referred to as an initial condensate solution). The initial condensate solution has a pH of from 6 to 8.

The initial condensate solution and the above prepared emulsion were mixed, and the mixture was adjusted to a pH of 6.0 with a 3.6% hydrochloric acid aqueous solution while stirring. The stirring was continued at 65° C. for 6 hours. After cooling to room temperature, the mixture was adjusted to a pH of 9.0 with a 20% aqueous solution of sodium hydroxide.

To the resulting microcapsule dispersion were added 200 parts of a 10% aqueous solution of polyvinyl alcohol (molecular weight of 22,000) and 50 parts of starch particles (diameter of 15 μ), and water was added thereto to provide a solids content of 20%. The resulting coating composition was coated on base paper having a basis weight of 50 g/m$^2$ to a solid coverage of 5 g/m$^2$ with an air knife coater, followed by drying to obtain a color former sheet.

Preparation of Color Developer Sheet

Ten parts of zinc 3,5-di-α-methylbenzylsalicylate were added to 20 parts of 1-isopropylphenyl-2-phenylethane, and the mixture was heated at 90° C. to form a solution. The resulting solution was added to 50 parts of a 2% aqueous solution of polyvinyl alcohol ("PVA-205" produced by Kuraray Co., Ltd.; molecular weight of 22,000), and 0.1 part of a 10% aqueous solution of sodium sulfosuccinate was added thereto as a surface active agent. The mixture was homogenized in a homogenizer to prepare an emulsion having a mean particle size of 3 μm.

A mixture of 80 parts of calcium carbonate, 20 parts of zinc oxide, 1 part of sodium hexametaphosphate, and 200 parts of water was dispersed in a Kedy mill for 15 min, and the resulting dispersion was mixed with the above prepared emulsion. To the mixture were added 100 parts of a 10% aqueous solution of polyvinyl alcohol ("PVA-110" produced by Kuraray Co., Ltd.; molecular weight of 44,000) and 10 parts (solid basis) of a carboxy-modified SBR latex ("SN-304" produced by Sumitomo Naugatuc Co., Ltd.; particle size of 0.3μ), and water was further added thereto to provide a solids content of 20%, to prepare a coating composition (A).

Separately, a mixture of 10 parts of zinc 3,5-di-α-methylbenzylsalicylate, 80 parts of calcium carbonate, 20 parts of zinc oxide, 1 part of sodium hexametaphosphate, and 200 parts of water was uniformly dispersed in a sand grinder to prepare a dispersion having a mean particle size of 3 μm.

To the resulting dispersion were added 100 parts of a 10% aqueous solution of PVA-110 and 10 parts (solid basis) of SN-304, and water was further added thereto to adjust the solids content to 20%, to prepare a coating composition (B).

The coating compositions (A) and (B) were mixed at a mixing weight ratio of 50/50 based on zinc 3,5-di-α-methylbenzylsalicylate conversion, and the mixed coating composition was coated on base paper having a basis weight of 50 g/m$^2$ to a solids coverage of 5.0 g/m$^2$ with an air knife coater, followed by drying to obtain a color developer sheet.

Recording was conducted in the same manner as in Example 1 to obtain a blue image. The resulting image had a high density and exhibited excellent fastness to light and heat.

EXAMPLE 6

Preparation of a Heat-Sensitive Recording Paper

Thirty parts of 3-(4-diethylamino-2-ethoxyphenyl)-3-(1-ethyl-2-methylindol-3-yl)phthalide were dispersed in a ball mill together with 150 parts of a 10% aqueous solution of polyvinyl alcohol (molecular weight of 44,000) and 70 parts of water for 12 hours to prepare a dispersion (A) having a mean particle size of about 1.5 μm.

Separately, 30 parts of zinc 4-β-(p-methoxyphenoxy)ethoxysalicylate, 30 parts of 2-benzyloxynaphthalene, 150 parts of a 10% aqueous solution of polyvinyl alcohol (molecular weight of 44,000), and 55 parts of water were dispersed in a sand mill to prepare a dispersion (B) having a particle size of about 2 μm.

Five parts of dispersion (A) and 40 parts of dispersion (B) were mixed, and the mixed dispersion was coated on paper and dried to obtain heat-sensitive recording paper having a solids coverage of 8 g/m$^2$.

The resulting heat-sensitive recording paper developed a blue color upon application of heat with a thermal pen, etc. The thus-formed color image was so stable to light that neither hue nor density underwent substantial change even when exposed to ultraviolet light (Ricopy-Super-Dry 1,000 manufactured by Ricoh Company, Ltd.) for one hour.

EXAMPLES 7 to 14

Preparation of Color Developer Sheet

Ten parts of the color developer shown in Table 2 was added to 20 parts of 1-isopropylphenyl-2-phenylethane, followed by heating to 90° C. to form a solution. The resulting solution was added to 50 parts of a 2% aqueous solution of polyvinyl alcohol ("PVA-117" produced by Kuraray Co., Ltd., molecular weight of 75,000), and 0.1 part of a 10% aqueous solution of triethanolamine dodecylbenzenesulfonate was further added thereto as a surface active agent. The mixture was homogenized in a homogenizer to prepare an emulsion having a mean particle size of 3 μm.

Then, 80 parts of calcium carbonate, 20 parts of zinc oxide, 1 part of sodium hexametaphosphate, and 200 parts of water were dispersed in a Kedy mill, and the resulting dispersion was mixed with the above-prepared emulsion. To the mixture was added 100 parts of a 10% aqueous solution of PVA-117 and 10 parts (solid basis) of a carboxy-modified SBR latex ("SN-307" produced by Sumitomo Naugatuc Co., Ltd.), as binders, and water was further added thereto to prepare a coating composition (A) having a solids content of 20%.

Separately, 10 parts of the same color developer as used above, 20 parts of silton clay, 60 parts of calcium carbonate, 20 parts of zinc oxide, 1 part of sodium hexametaphosphate, and 200 parts of water were uniformly dispersed in a sand grinder to prepare a dispersion having a mean particle size of 3 μm. To the dispersion were added 16 parts of a 10% aqueous solution of polyvinyl alcohol ("PVA-103" produced by Kuraray Co., Ltd.; molecular weight of 13,000, 100 parts of a 10% aqueous solution of PVA-117, and 10 parts (solid basis) of SN-307, and water was added to provide a solids content of 20% to prepare a coating composition (B).

The coating compositions (A) and (B) were mixed at a mixing ratio of 50/50 based on color developer conversion, and the mixed coating composition was coated on a base paper having a basis weight of 50 g/m$^2$ to a solids coverage of 5.0 g/m$^2$ followed by drying to obtain a color developer sheet.

Preparation of Color Former Sheet

I. Melamine/Formaldehyde Resin Capsules

A color former sheet was prepared in the same manner as in Example 5, except for replacing 3-(4-diethylamino-2-ethoxyphenyl)-3-(1-octyl-2-methylindol-3-yl)phthalide with the color former(s) shown in Table 2 and using a 3.6% phosphoric acid aqueous solution for pH adjustment of the mixture of the initial condensate solution and the emulsion in place of the 3.6% hydrochloric acid aqueous solution. (Examples 7, 10, 11, and 12).

II. Polyurethaneurea Capsules

A 3.5% oily solution comprising 30 g of diisopropylnaphthalene and the color former shown in Table 2 was mixed with 8 g of a polyisocyanate compound (addition product of 3 mols of tolylene diisocyanate and 1 mol of trimethylolpropane) and 1 g of a polyhydroxy compound (ethylenediamine/propylene oxide adduct) as wall-forming materials at 20° C. or lower to prepare a solution (A).

Separately, 3 g of polyvinyl alcohol (molecular weight of 22,000 and 1.5 g of sodium carboxymethyl cellulose (molecular weight of 30,000) were dissolved in 44 g of water at 20° C., and 0.1 g of Turkey red oil was added thereto as an emulsifier to prepare a solution (B).

Solution (A) was poured into solution (B) while vigorously stirring to form an oil-in-water emulsion. When the size of oil droplets became 4.5 μm, the stirring was slowed, and 100 g of water at 20° C. was added thereto. The temperature of the system was gradually elevated to 75° C., at which temperature the emulsion was kept for 60 minutes.

To the resulting capsule dispersion were added 25 g of a 15% aqueous solution of polyvinyl alcohol (molecular weight of 22,000), 42 g (solid basis) of a carboxy-modified SBR latex (particle size of 0.3 μ), and 20 g of starch particles having a mean particle size of 15 μm. Water was then added to adjust the solids content to 20%.

The resulting coating composition was coated on base paper having a basis weight of 50 g/m$^2$ with an air knife coater to a dry coverage of 5 g/m$^2$ to obtain a color former sheet (Examples 8, 11 and 13).

III. Gelatin Capsules

In 120 parts of water at 40° C. were dissolved 20 parts of an acid-processed gelatin having an iso-electric point of 8.0 and 20 parts of gum arabic, and 0.4 part of a sodium alkylbenzenesulfonate was added thereto as an emulsifier. To the solution was added 200 parts of a 3.5% solution comprising 200 parts of diisopropylnaphthalene and the color former of Table 2 while vigorously stirring. When the size of the oil droplets became 4.5 μm, 200 parts of water at 40° C. was added thereto to suppress further progress of emulsification.

To the emulsion was added 420 parts of water at 30° C., with stirring, and the system was adjusted to a pH of 4.4 with 20% acetic acid. While continuing the stirring, the emulsion was cooled to 8° C., and 1.0 part of a 37% formaldehyde aqueous solution and 1.5 parts of a 20% glutaraldehyde aqueous solution were added thereto. Then, 60 parts of a 10% aqueous solution of carboxymethyl cellulose (molecular weight of 30,000) was poured into the emulsion, and a 25% aqueous solution of sodium hydroxide was added dropwise thereto to adjust it to a pH of 9.5, followed by raising the temperature of the system to 30° C. for 10 min. to harden the capsule walls. To the capsule dispersion were added 200 parts of a 10% aqueous solution of polyvinyl alcohol (molecular weight of 22,000) and 50 parts of starch particles (particle diameter of 15μ), and water was added to provide a solids content of 20%.

The resulting microcapsule dispersion was coated on a base paper having a basis weight of 50 g/m$^2$ with an air knife coater to a solids coverage of 5 g/m$^2$, followed by drying to obtain a color former sheet.

The thus prepared color developer sheets and the color former sheets were combined in coating-to-coating contact as shown in Table 2 to obtain pressure-sensitive recording material samples. Each of the samples was evaluated for fog when dipped in water or when preserved under pressure and humidity in accordance with the following test method, and the results obtained are shown in Table 2.

Test I: Fog on Water Immersion

Both the color developer sheet and the color former sheet were dipped in water, brought into contact with their coating layers facing each other, and air-dried. The fog density on the color former sheet was determined using a stand and method with a Backman DB type spectrophotometer.

Test II: Fog under Pressure and Humidity

The dry color developer sheet and dry color former sheet were brought into contact with their coating layers facing each other. The sample was maintained under a pressure of 100 g/cm$^2$, at a temperature of 50° C., and at a relative humidity of 90% for 24 hours. After this time, the fog on the color developer sheet was visually evaluated and rated as A (good), B (acceptable) or C (unacceptable).

TABLE 2

| Example No. | Color Former | Color Developer | Capsules | Test Results I | Test Results II |
|---|---|---|---|---|---|
| 7 | 3-(4-diethylamino-2-ethoxy-phenyl)-3-(1-ethyl-2-methyl-indol-3-yl)phthalide (3.5%)* | Zinc 3,5-bis(α-methyl-benzyl)salicylate | melamine/ formaldehyde resin | 0.10 | A |
| 8 | 3-(4-diethylamino-2-ethoxy-phenyl)-3-(1-ethyl-2-methyl-indol-3-yl)phthalide (3.5%)* | Zinc 3,5-bis(α-methyl-benzyl)salicylate | polyurethane-urea | 0.11 | A |
| 9 | 3-(4-diethylamino-2-ethoxy-phenyl)-3-(1-ethyl-2-methyl-indol-3-yl)phthalide (3.5%)* | Zinc 3,5-bis(α-methyl-benzyl)salicylate | gelatin | 0.31 | C |
| 10 | 3-(4-dibutylamino-2-ethoxy-phenyl)-3-(1-ethyl-2-methyl-indol-3-yl)phthalide (2.5%)* Crystal Violet Lactone (1.0%)* | Zinc 3,5-bis(α-methyl-benzyl)salicylate | melamine/ formaldehyde resin | 0.09 | A |
| 11 | 3-(4-diethylamino-2-ethoxy-phenyl)-3-(1-ethyl-2-methyl-indol-3-yl)phthalide (2.5%)* 3,6-bis(diphenylamino)fluoran (1.0%)* | Zinc 3,5-bis(α-methyl-benzyl)salicylate | melamine/ formaldehyde resin | 0.13 | A |
| 12 | 3-(4-diethylamino-2-ethoxy-phenyl)-3-(1-ethyl-2-methyl-indol-3-yl)phthalide (3.5%)* | zinc 5-α-(α-methyl-benzyl)phenethyl-salicylate | melamine/ formaldehyde resin | 0.11 | A |
| 13 | 3-(4-diethylamino-2-ethoxy-phenyl)-3-(1-ethyl-2-methyl-indol-3-yl)phthalide (3.5%)* | zinc 5-α-(α-methyl-benzyl)phenethyl-salicylate | polyurethane-urea | 0.13 | A |
| 14 | 3-(4-diethylamino-2-ethoxy-phenyl)-3-(1-ethyl-2-methyl-indol-3-yl)phthalide (3.5%)* | zinc 5-α-(α-methyl-benzyl)phenethyl-salicylate | gelatin | 0.29 | C |

Note:
*Values in the parentheses indicate concentrations.

It can be seen from the results in Table 2 that in the pressure-sensitive recording materials according to the present invention, fog due to contact with water or transfer fog on storage under high humidity conditions can be prevented by using a synthetic resin as a wall-forming material.

While the invention has been described in detail and with reference to specific embodiments thereof, it will be apparent to one skilled in the art that various changes and modifications can be made therein without departing from the spirit and scope thereof.

What is claimed is:

1. A recording material comprising a support having thereon the combination of at least one electron-donating colorless dye comprising a p-substituted aminophenylindolyl-phthalide moiety and at least one electron-accepting compound comprising an organic acid having at least one phenolic hydroxyl group selected from the group consisting of zinc 3,5-bis(α-methylbenzyl)salicylate and zinc 5-α-(α-methylbenzyl)-phenethylsalicylate.

2. A recording material as in claim 1, wherein said colorless dye is a p-substituted aminophenylindolylphthalide derivative represented by formula (I):

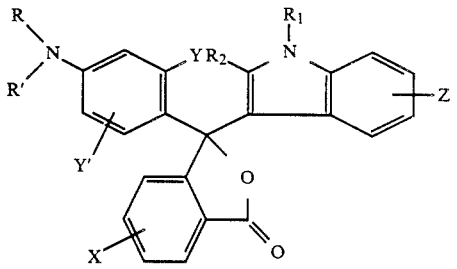

(I)

wherein R and R', which may be the same or different, each represents a substituted or unsubstituted alkyl group; $R_1$ and $R_2$, which may be the same or different, each represents a substituted or unsubstituted alkyl group or a substituted or unsubstituted aryl group; X represents a hydrogen atom, a substituted or unsubstituted alkyl group, a substituted or unsubstituted alkoxy group, a substituted or unsubstituted aryloxy group or a haologen atom; and Y, Y', and Z, which may be the same or different, each represents a hydrogen atom, a substituted or unsubstituted alkyl group, a halogen atom, a substituted amino group or a substituted or unsubstituted alkoxy group.

3. A recording material as in claim 2, wherein R and R' each represents an alkyl group having from 1 to 10 carbon atoms, an alkoxyalkyl group having from 2 to 10 carbon atoms, a halogen-substituted alkyl group having from 1 to 10 carbon atoms or an aryloxyalkyl group having from 7 to 12 carbon atoms.

4. A recording material as in claim 2, wherein $R_1$ represents an unsubstituted alkyl group having from 1 to 12 carbon atoms, an alkyl group having from 1 to 12 carbon atoms which is substituted with an aryl group, an alkoxy group, an aryloxy group or a halogen atom, an unsubstituted phenyl or naphthyl group having from 6 to 10 carbon atoms, or a phenyl or naphthyl group having from 6 to 10 carbon atoms which is each substituted with an alkyl group, an alkoxy group or a halogen atom.

5. A recording material as in claim 2, wherein $R_2$ represents an alkyl group having from 1 to 8 carbon atoms, or a phenyl or naphthyl group having from 6 to 10 carbon atoms.

6. A recording material as in claim 2, wherein X represents a hydrogen atom, an alkoxy group having from 1 to 6 carbon atoms, an aryloxy group having from 6 to 10 carbon atoms, a chlorine atom or a fluorine atom.

7. A recording material as in claim 2, wherein Y and Y′ each represents a hydrogen atom, an alkyl group having from 1 to 12 carbon atoms, an acyloxy group, a substituted amino group or an alkoxy group.

8. A recording material as in claim 2, wherein Z represents a hydrogen atom, an alkyl group having from 1 to 6 carbon atoms or an alkoxy group.

9. A recording material as in claim 2, wherein $R_2$ represents an alkyl group and the total number of carbon atoms in R, R′, Y, $R_1$, and $R_2$ is at least 11.

10. A recording material as in claim 2, wherein R represents an alkyl group and the total number of carbon atoms in $R_1$ and Y is at least 4.

11. A recording material as in claim 2, wherein $R_2$ represents an aryl group and the total number of carbon atoms in R, R′, Y, $R_1$, and $R_2$ is at least 14.

12. A recording material as in claim 2, wherein $R_2$ represents an alkyl group, Y represents an alkoxy group, and $R_1$ or Y has at least 4 carbon atoms.

13. A recording material as in claim 2, wherein $R_2$ represents an alkyl group, Y represents an alkoxy group, and $R_1$ or Y has from 6 to 12 carbon atoms.

14. A recording material as in claim 2, wherein said p-substituted aminophenylindolylphthalide derivative is a 4-substituted amino-2-alkoxyphenylindolylphthalide.

15. A recording material as in claim 1, wherein said colorless dye is a 4-substituted amino-2-alkoxyphenylindolylphthalide, and said organic acid is a di-substituted salicylic derivative having at least 13 carbon atoms or a metal salt thereof.

16. A recording material as in claim 1, wherein said recording material is a pressure-sensitive recording material comprising the colorless dye encapsulated in microcapsules having a capsule wall composed of a synthetic resin.

17. A recording material as in claim 16, wherein said synthetic resin is a polyurethane, a polyurea, a polyurethaneurea or a melamine/formaldehyde resin.

18. A recording material as in claim 1, wherein the colorless dye and the electron-accepting compound are used at a weight ratio of from about 1:10 to 2:3.

* * * * *